US009322595B1

(12) United States Patent
Shinn

(10) Patent No.: US 9,322,595 B1
(45) Date of Patent: Apr. 26, 2016

(54) METHOD AND APPARATUS FOR CONDITIONING OF FRACTURING SAND

(71) Applicant: Industrial Accessories Company, Mission, KS (US)

(72) Inventor: Donald E. Shinn, Lenexa, KS (US)

(73) Assignee: Industrial Accessories Company, Mission, KS (US)

( * ) Notice: Subject to any disclaimer, the term of this patent is extended or adjusted under 35 U.S.C. 154(b) by 122 days.

(21) Appl. No.: 14/487,536

(22) Filed: Sep. 16, 2014

Related U.S. Application Data

(60) Provisional application No. 61/879,345, filed on Sep. 18, 2013.

(51) Int. Cl.

| | |
|---|---|
| ***F26B 9/04*** | (2006.01) |
| ***F26B 21/00*** | (2006.01) |
| ***F26B 25/16*** | (2006.01) |
| ***F26B 23/00*** | (2006.01) |

(52) U.S. Cl.
CPC ..... *F26B 21/004* (2013.01); *F26B 23/00* (2013.01); *F26B 25/16* (2013.01)

(58) Field of Classification Search
CPC ..... F26B 3/00; F26B 5/00; F26B 9/00; F26B 9/08; C10L 5/00; C10L 9/00; C10L 9/08; B01D 3/00; B01F 9/00; B01F 9/06; B01F 3/00; B01F 3/18
USPC ..... 34/443, 59, 86, 130; 44/626, 629; 202/185.1; 366/144, 227; 210/323.1
See application file for complete search history.

(56) References Cited

U.S. PATENT DOCUMENTS

| | | | | |
|---|---|---|---|---|
| 4,384,787 | A * | 5/1983 | Ito | B01D 43/00 210/787 |
| 4,389,794 | A * | 6/1983 | Bitterly | B01J 3/006 34/287 |
| 4,945,657 | A * | 8/1990 | Shinn | F26B 11/0413 34/128 |
| 4,977,839 | A * | 12/1990 | Fochtman | B09B 3/0091 110/226 |
| 5,555,639 | A * | 9/1996 | Livingston | F26B 11/0413 34/135 |
| 8,091,252 | B2 * | 1/2012 | Kim | D06F 58/26 137/2 |
| 8,205,350 | B2 * | 6/2012 | Aaron | F26B 5/08 34/58 |
| 8,579,999 | B2 * | 11/2013 | Bullinger | C10L 9/08 44/626 |
| 2005/0236320 | A1 * | 10/2005 | Didion | B01F 9/06 210/323.1 |
| 2008/0201980 | A1 * | 8/2008 | Bullinger | B03B 4/06 34/493 |
| 2010/0107439 | A1 * | 5/2010 | Shivvers | F26B 17/122 34/477 |
| 2011/0232124 | A1 * | 9/2011 | Shivvers | F26B 3/205 34/428 |

FOREIGN PATENT DOCUMENTS

| | | | | |
|---|---|---|---|---|
| WO | WO 2009114142 | A3 * | 12/2009 | F26B 3/08 |
| WO | WO 2012017092 | A1 * | 2/2012 | C02F 11/12 |

* cited by examiner

*Primary Examiner* — Stephen M Gravini

(74) *Attorney, Agent, or Firm* — Hovey Williams LLP

(57) ABSTRACT

An improved, energy efficient method and apparatus for conditioning of fracturing sand provides an elongated, rotatable drying/cooling shell with co-current flow of heated air and sand through the shell. Structure operable to deliver additional quantities of wet sand into the shell is provided at a zone between the shell inlet and outlet, and downstream of the point where the initial quantity of wet sand is substantially dry. The additional quantities of wet sand mix with the initial quantities of substantially dry sand in order to evaporatively dry the additional quantity of wet sand, and to cool the initial and additional quantities of wet sand.

6 Claims, 9 Drawing Sheets

METHOD AND APPARATUS FOR CONDITIONING OF FRACTURING SAND

CROSS-REFERENCE TO RELATED APPLICATION

This application claims the benefit of US Provisional Application Ser. No. 61/879,345, filed Sep. 18, 2013, which is incorporated by reference herein in its entirety.

BACKGROUND OF THE INVENTION

1. Field of the Invention

The present invention is broadly concerned with improved methods and apparatus for the drying/cooling of fracturing sands used in petroleum rock formations. More particularly, the invention is concerned with such methods and apparatus wherein use is made of an induced-draft, co-current, single-pass rotary dryer equipped with an additional wet sand input device situated between the primary wet sand inlet at one end of the dryer, and a dried sand outlet at the other end thereof. The additional wet sand added to the dryer serves to cool the initially introduced dried sand while simultaneously drying the additional wet sand by evaporation. The final conditioned product from the rotary dryer has suitable moisture and temperature levels for downstream sizing.

2. Description of the Prior Art

Some subsurface rock formations, such as organic shales, contain large amounts of oil, natural gas, or natural gas liquids that will not flow freely to a well because the rock formations either lack permeability, or the pore spaces are so small that these fluids cannot readily flow through them. The hydraulic fracturing process addresses these problems by generating fractures in the rock formations. This is done by drilling a well into the rock, sealing the portion of the well in the petroleum-bearing zone, and pumping water under high pressure into that well zone. This water is generally treated with chemicals and thickeners to create a viscous gel, which suspends grains of fracturing sands. Large pumps are used to increase the water pressure until it is high enough to exceed the breaking point of the rock formations. When this breaking point is reached, the formations fracture suddenly and water rushes into the fractures, inflating them and extending them deeper into the rock. When the pumps are deactivated, the fractures deflate, but do not close completely, because they are propped open by billions of grains of the fracturing sand. The new fractures in the rock, propped open by the sand grains, form a network of pore spaces that allow petroleum fluids to flow out of the rock and into the well. Thus, fracturing sand is also known as a "proppant," because it props the rock fractures open.

Fracturing sand, generally referred to in the art as "frac sand," is desirably a high-purity quartz sand with very durable and round grains. Most frac sand is a natural material derived from high-purity sandstone. The demand for frac sand has exploded in the past several years as thousands of oil and natural gas wells are being stimulated using the hydraulic fracturing process. A hydraulic fracturing job on a single well may require several thousand tons of sand. Accordingly, a substantial frac sand industry has developed in the past few years.

Frac sand products must meet very demanding specifications in order to be used in fracturing operations. The sand grains should be substantially spherical in shape, have size specifications matched to particular job applications, and be highly durable to resist crushing. Such sands may be dredged or mined from naturally occurring sources, especially in Wisconsin and Texas. However, frac sand cannot be used straight from the ground, and it must be subjected to conditioning in specialized frac sand plants. In such facilities, the native sand is first washed in a "wet plant," where mud and slimes are separated, along with very fine sand grains. After wet plant treatment, the clean sand has a moisture content of approximately 6-7% by weight, and cannot be screened or otherwise size-classified in this condition. Therefore, the wet sand must be dried to a relatively low moisture content on the order of 0.5% by weight in order to permit sizing. Moreover, the hot, dried sand must be cooled before sizing, in order to prevent damage to downstream equipment.

A variety of equipment has been employed in the past for the drying and cooling of wet frac sand. These are generally referred to as fluid bed dryers (both static and vibratory), and rotary dryers of counter-current or co-current design. A known rotary dryer may include integrated cooling features, where incoming sand is dried in an inner pass of the dryer and is cooled in an outer pass. It has also been known to add wet sand to the dried but not yet cool sand in the aforementioned multiple-pass rotary dryer, so that cooling is enhanced by evaporation of water from the moist sand proportion. However, such a dryer/cooler has very high horsepower requirements (e.g., 200 HP), and therefore equipment and utility costs become significant.

Fluid bed dryers have a number of significant disadvantages. They are optimally suited only for fine-grain materials having a diameter of about 4-6 mm, and have only limited drying air temperature ranges. Such units are also sensitive to abrupt changes in solid material particle sizes, moisture content, throughput rates, and periodic cutouts of drying air. Moreover, this type of equipment has relatively high electrical energy requirements, and expensive air systems consisting of fans, ducts, and separate hot gas generator equipment. Consequently, significant efforts and expenses are involved in commissioning fluid bed dryer systems for parameter optimization. Fluid bed dryer systems are necessarily light-weight designs for ease of startup on vibratory or shaker models, and require high differential pressures to overcome higher fan compressions and horsepowers. In many systems, stainless steel chambers or perforated troughs may be required for heat tolerance.

Static bed dryers may require refractory lined gas chambers and have high air volume requirements owing to limited hot gas requirements. The low temperature cooling air which is captured during operation can be near dew point depression levels, resulting in baghouse plugging.

Generally speaking, drum dryer systems have a number of advantages, including low heat energy requirements even when drying only partial loads, by simple adjustment of exhaust air volumes. Also, it is usually not necessary to adjust the air volumes during product change-overs. The air exhaust equipment from the drum dryer is comparatively simple inasmuch as air is extracted from only one point on the dryer. Consequently, drum dryer systems are simple to install and commission, tolerant to operating faults, very rugged with long service lifetimes, and have low wear and replacement part requirements.

Rotary dryer systems may be either counter-current or co-current design. Counter-current systems have a number of disadvantages. Since there is no relationship between the exhaust gap temperature, the burner must be controlled by the temperature of the material exiting the dryer. However, change in process conditions is based upon the incoming material, not the exiting material. Therefore, the response of the burner is not known for several minutes until the dryer has cycled through the established residence time for the material. Further, since the feed material is entering on the cool, wet end of the dryer, a quick flash of evaporation usually occurs in the middle section of the drum instead of near the out-feed end. It is therefore not unusual for a cake ring to form on the shelf just prior to the quick-flash location. Given the limited control of the discharge gas temperature in these systems, there is a real danger that the exhaust gap temperature will drop below the dew point, especially in the winter. This increases the risk of mudding of the bag filters in the dust collector. Since the control of countercurrent systems has a long lag time, most operators tend to over-dry and over-heat the incoming material so that the system will run more smoothly. In contrast, co-current dryer designs rely upon the exhaust gas temperature for control, because the gas molecules travel through the dryer in seconds, instead of the minutes required for product travel time.

There is accordingly a need in the art for more efficient equipment and methods for the drying and cooling of wet frac sand, than has heretofore been available.

SUMMARY OF THE INVENTION

The present invention overcomes the problems outline above, and provides a highly efficient rotary dryer assembly for the drying of wet fracturing sand. Generally speaking, the assembly includes a single, elongated, single-pass, axially rotatable shell presenting a wet sand inlet adjacent one end of the shell and sized to receive an initial quantity of wet sand, and a dry sand outlet adjacent the opposite end of the shell. Apparatus is also provided to induce co-current air flow through and along the length of the shell (i.e., both the air currents and frac sand travel in the same direction through the shell), to heat the air, in order to substantially dry the initial quantity of wet sand within the shell. The shell is also equipped with structure operable to deliver an additional quantity of wet sand into the shell at an zone between the inlet and the outlet, and downstream of the point where the initial quantity of wet sand is substantially dry. In operation, the additional quantity of wet sand mixes with the initial quantity of substantially dry sand in order to evaporatively dry the additional quantity of wet sand, and to cool the initial and additional quantities of wet sand for delivery thereof to the outlet.

Use of the simplified, one-pass dryer of the invention reduces both equipment and operating costs while still providing properly conditioned sand for downstream processing.

DETAILED DESCRIPTION OF THE PREFERRED EMBODIMENT

Figure 2:
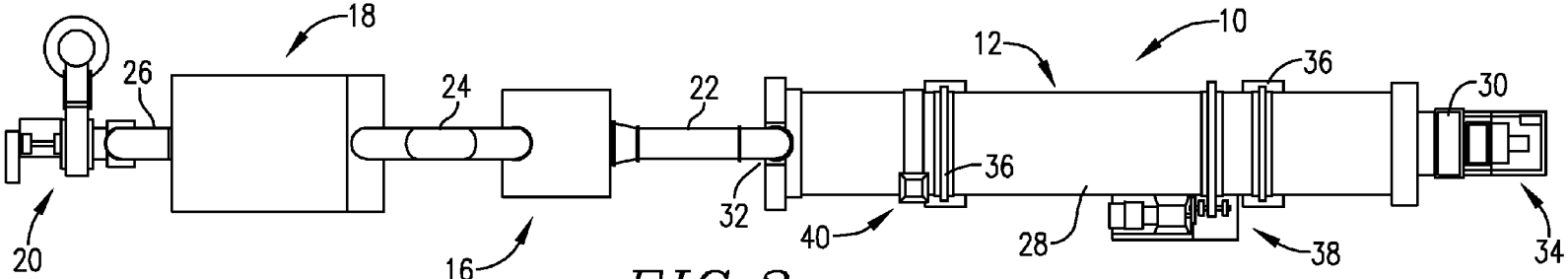
FIG. 2 is a plan view of the fracturing sand drying plant of FIG. 1.
Figure 3:
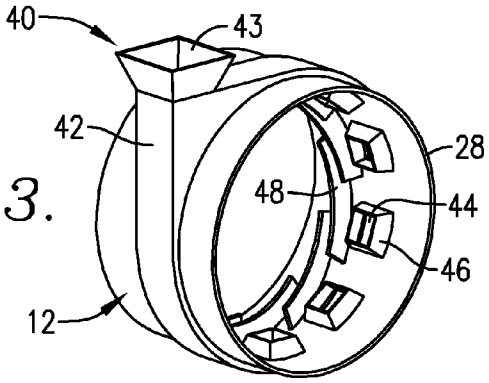
FIG. 3 is a partial perspective view of the collar in-feed assembly forming a part of the dryer/cooler drum of the invention.
Figure 1:
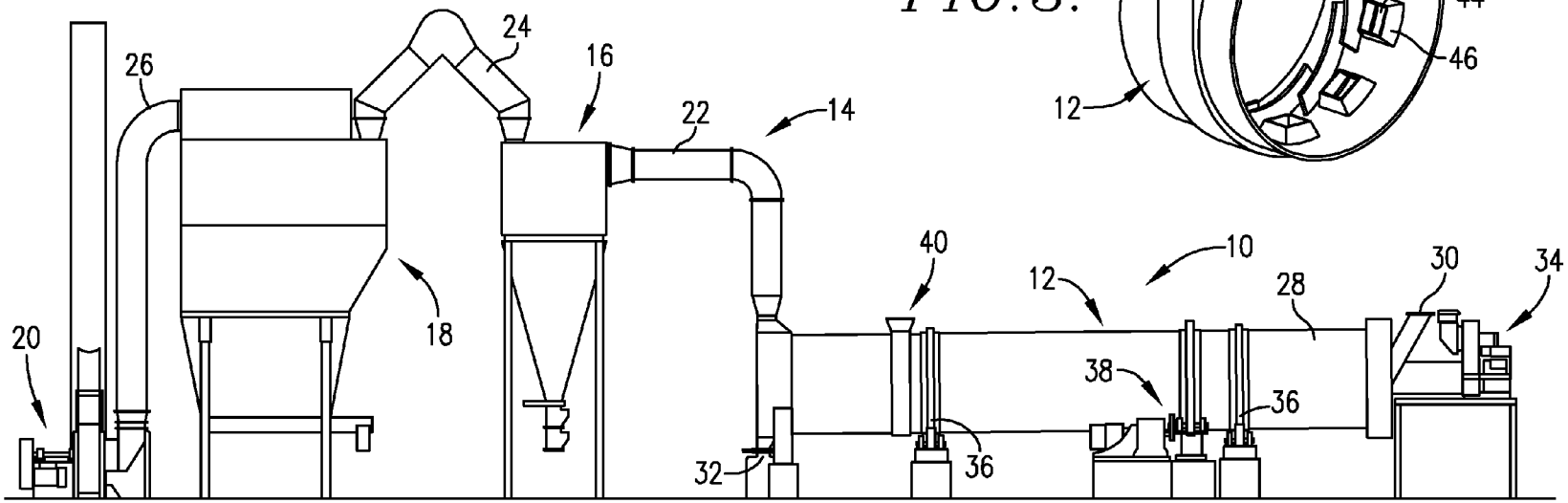
FIG. 1 is an elevational view of a fracturing sand drying plant in accordance in accordance with the invention.
Figure 4A:
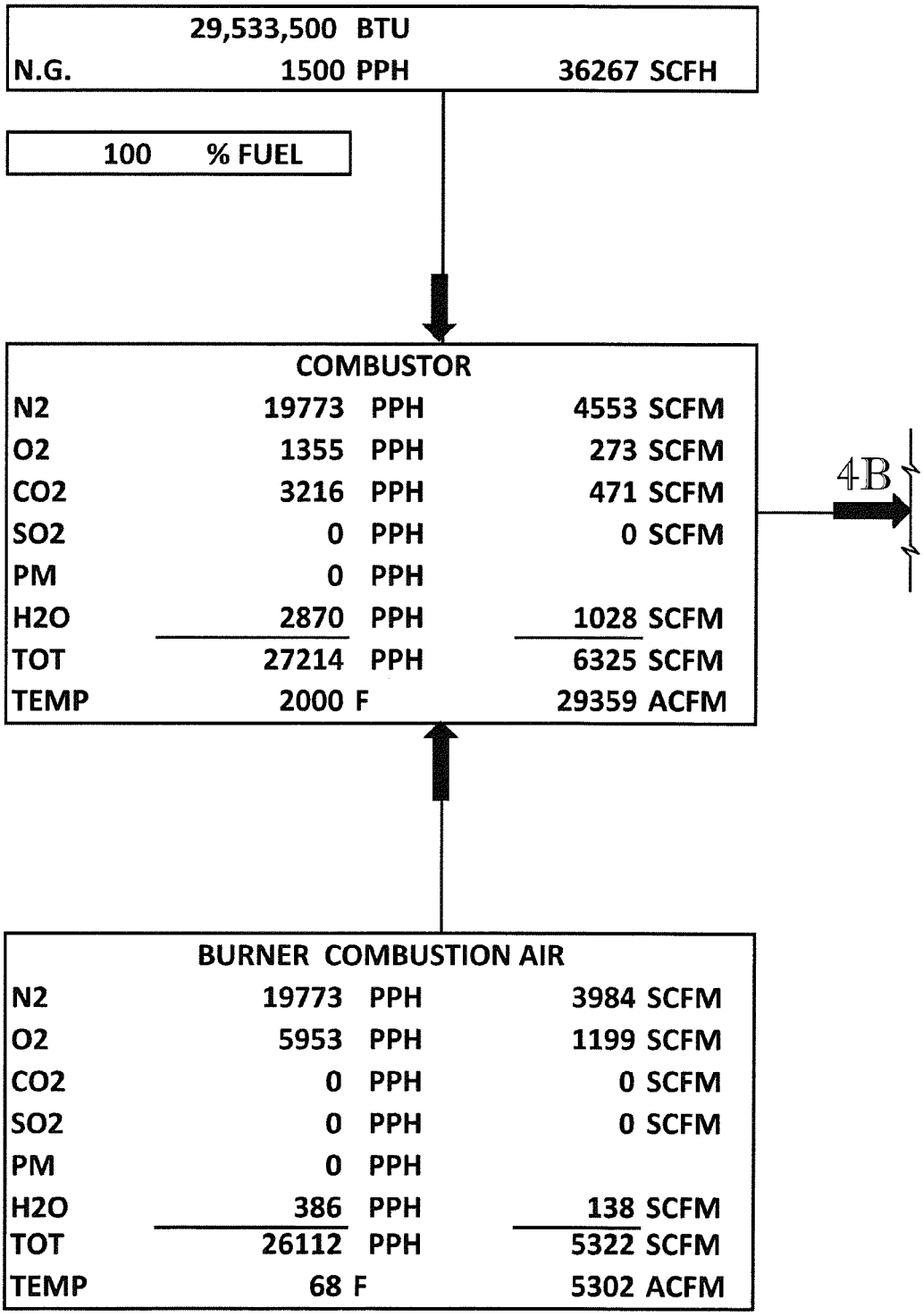
FIGS. 4A-4H are individual portions of an overall flow diagram which together present modeling data of one embodiment of the present invention.
Figure 4B:
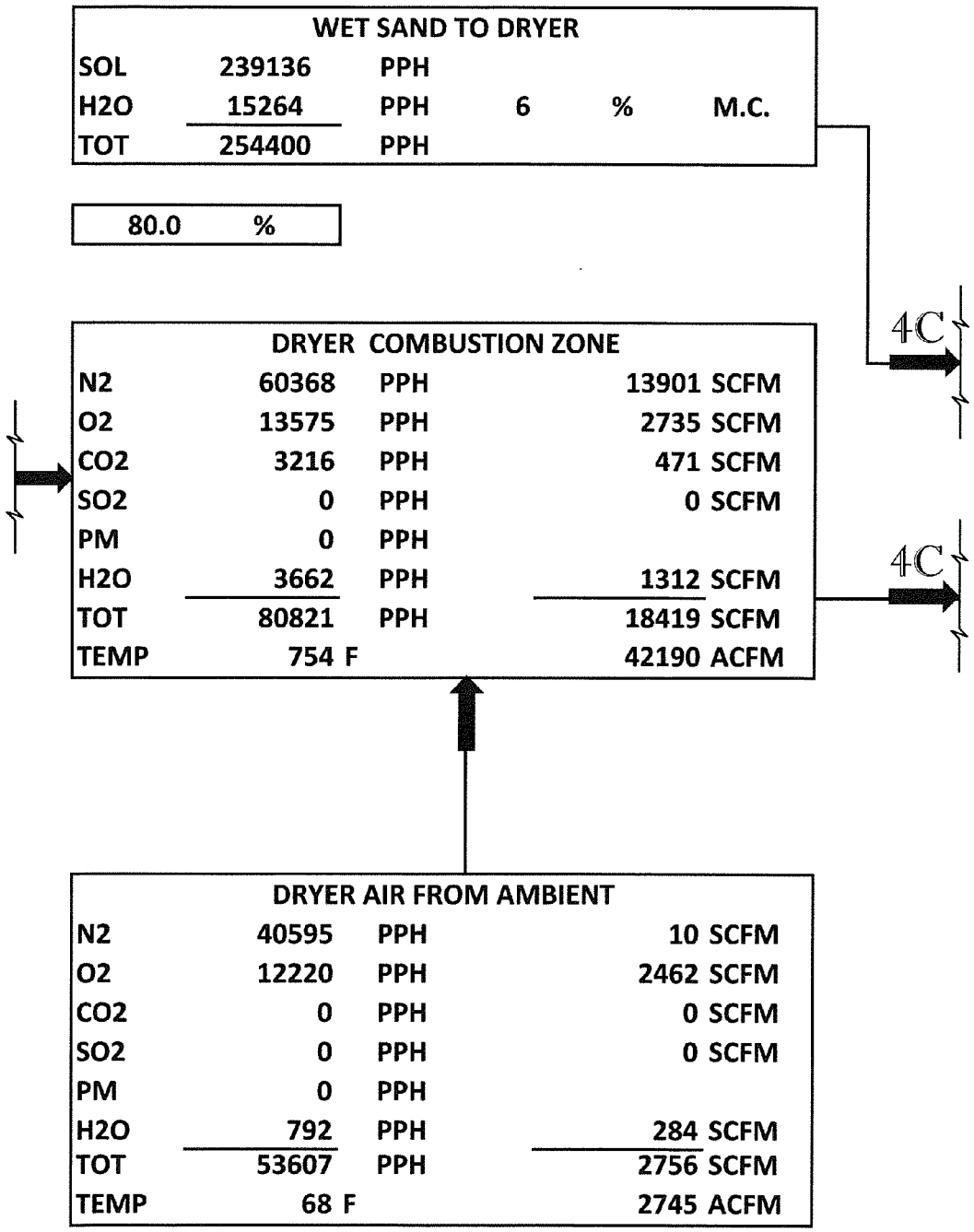
Figure 4C:
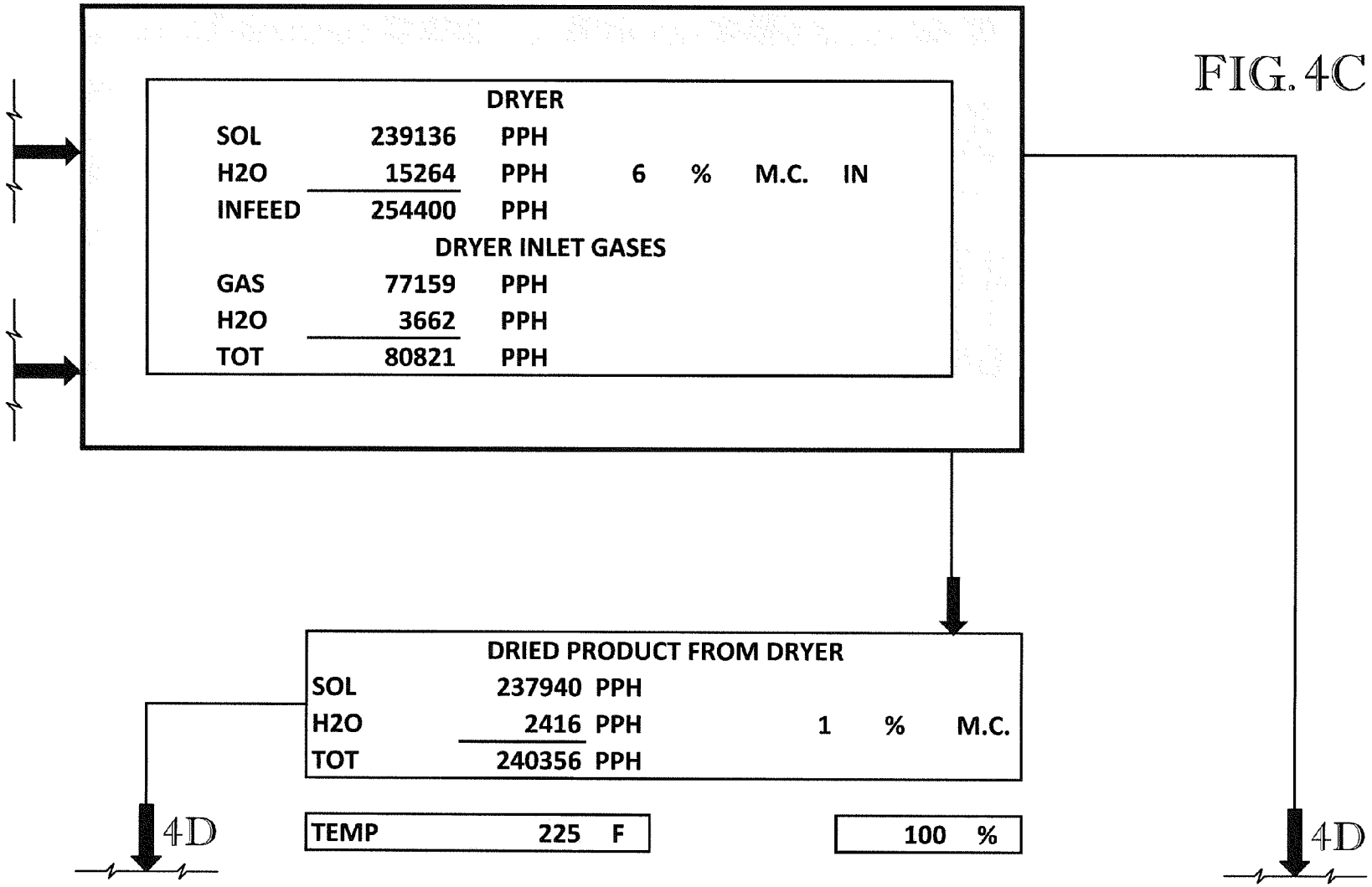
Figure 4D:
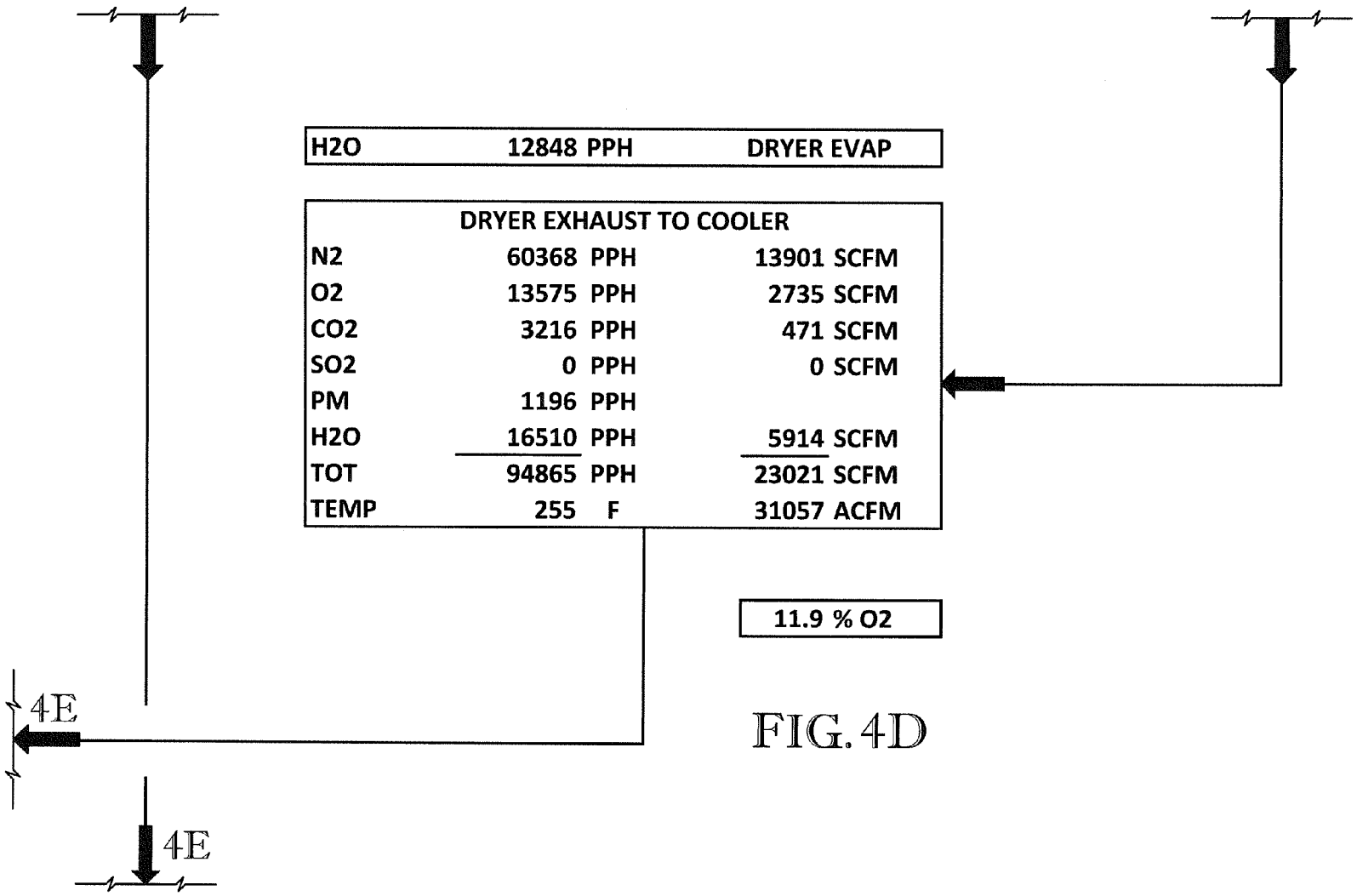
Figure 4E:
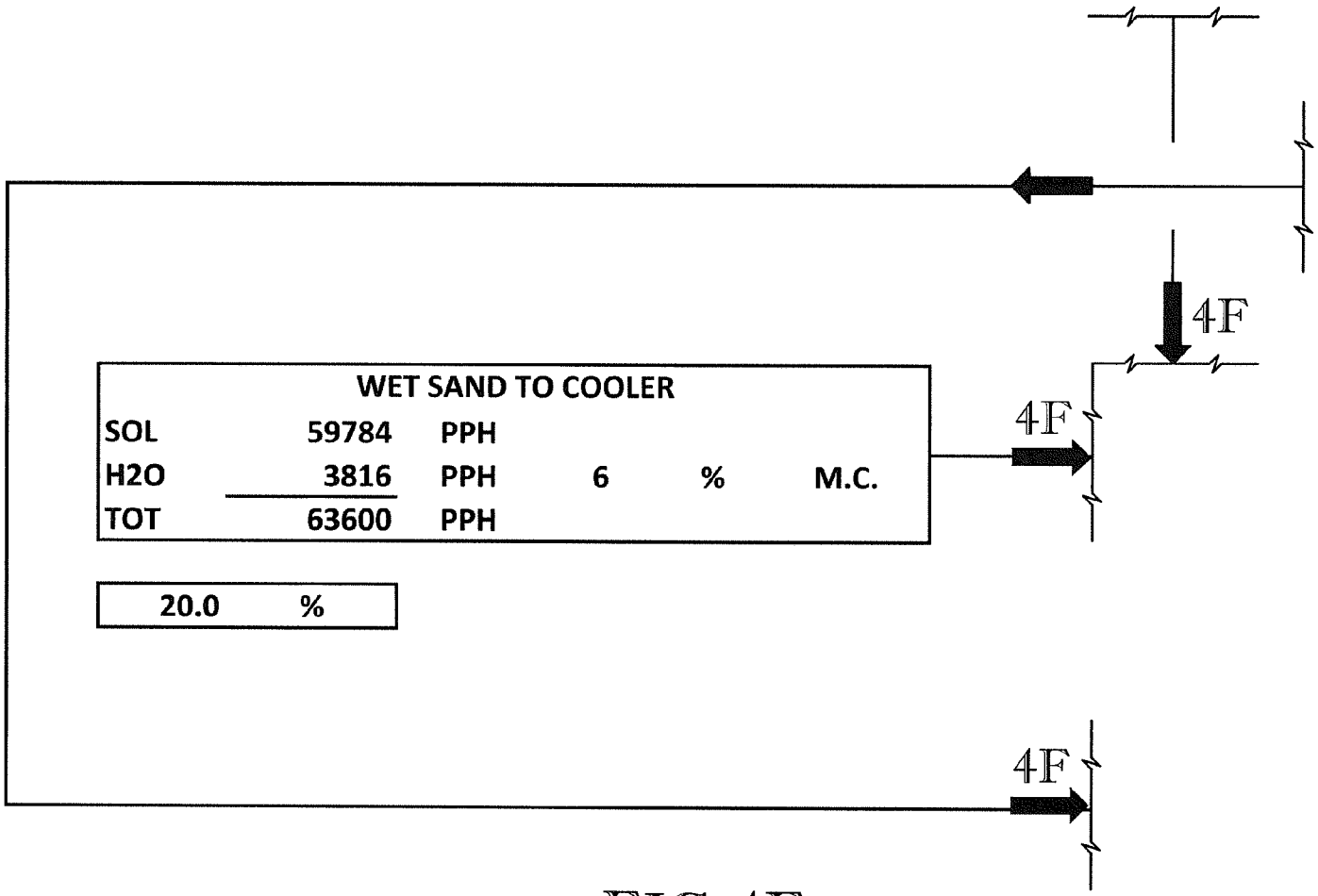
Figure 4F:
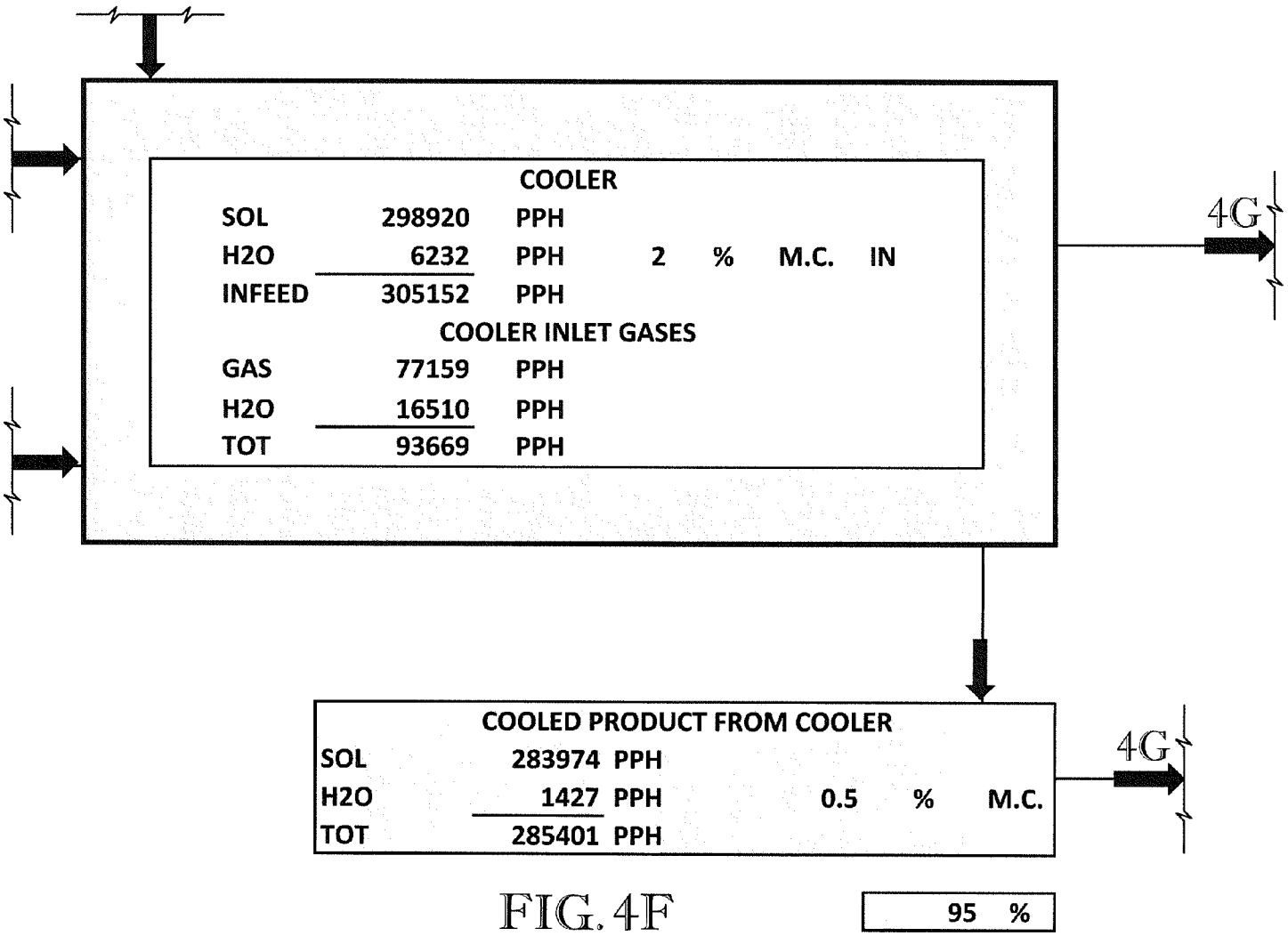
Figure 4G:
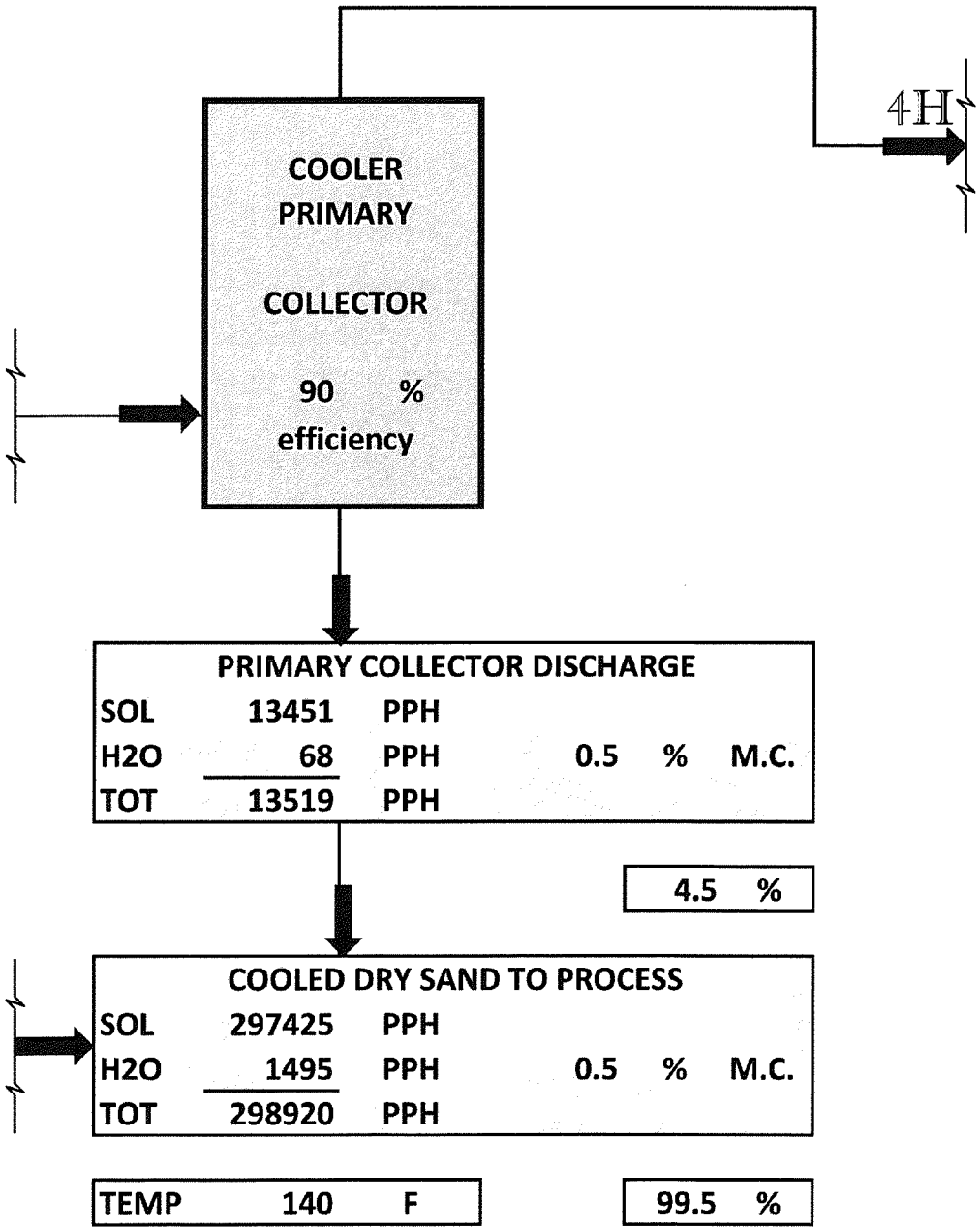
Figure 4H:
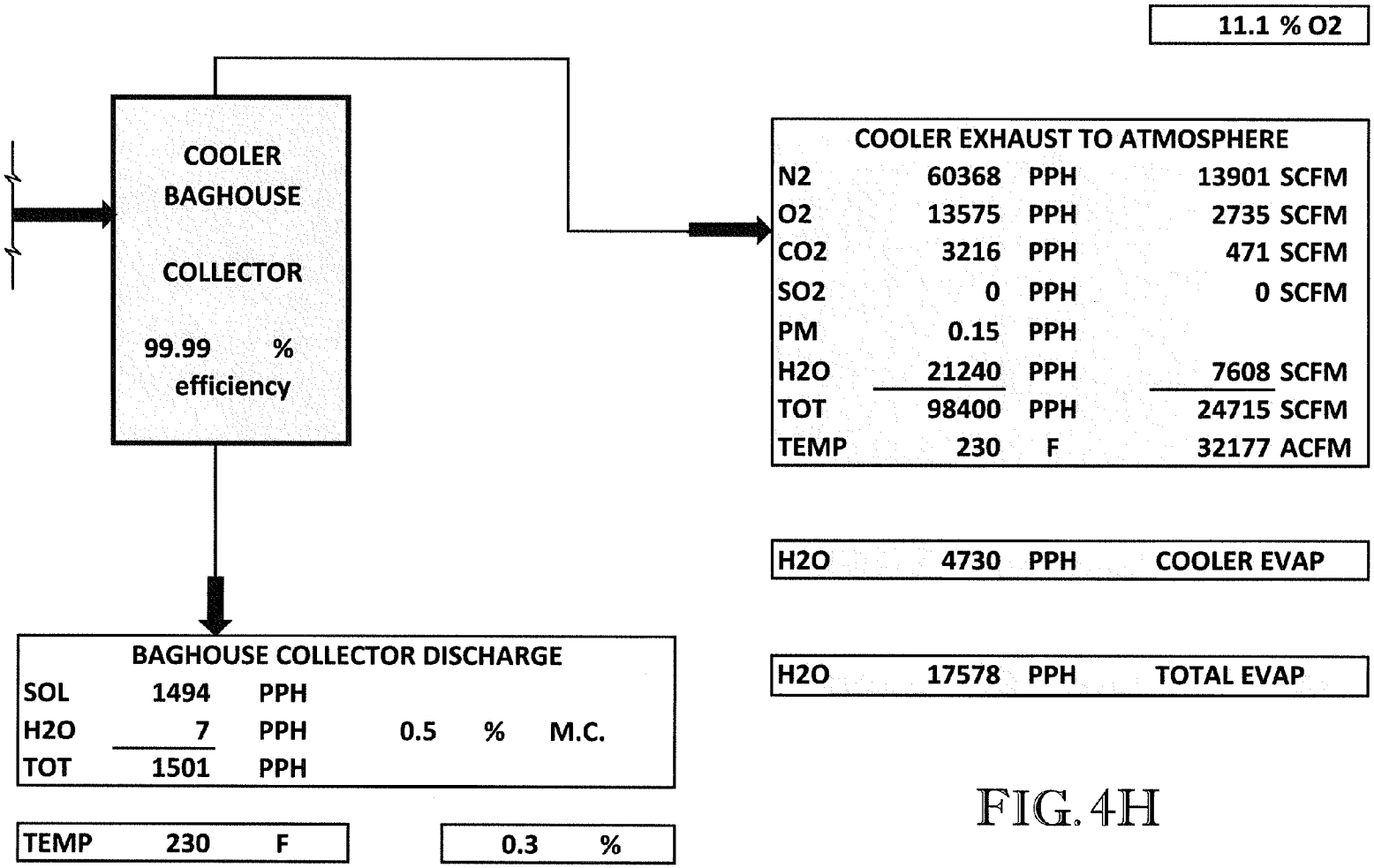

Turning now to FIGS. 1 and 2, a wet fracturing sand drying plant assembly 10 is illustrated, which broadly includes an induced-draft, single-pass, co-current rotary dryer 12, and a particulate removal system 14 including a knock-out box 16 and baghouse filter 18. An induced-draft dryer fan 20 is situated upstream of the system 14 and dryer 12, as shown. Appropriate ducts 22, 24, and 26 operably interconnect the dryer 12, knock-out 16, baghouse filter 18, and fan 20. The components of the particulate removal system are conventional, and therefore need not be described in detail.

The dryer 12 includes an elongated tubular shell 28 having a wet sand inlet 30 and a dry sand outlet 32, located at the opposite extreme ends of the shell 28. A burner/blower 34 is located at the inlet end of shell 28 and is operable to heat the air passing in a co-current fashion through the shell 28. The shell 28 is oriented at a small downward angle, such that the inlet end thereof is above the outlet end thereof. The shell 28 is mounted on rotatable shell supports 36, and a trunion drive 38 is provided to axially rotate shell 28. Internally, the shell 28 is equipped with a series of inwardly extending, alternate, circumferentially spaced apart lifting flights (not shown), which continuously lift the fracturing sand and create veils or curtains of sand along the length of the shell which encounter the drying air currents.

Importantly, the shell 28 is also equipped with a stationary collar in-feed assembly 40 permitting additional quantities of wet sand to be added into a zone within shell 28 between the inlet 30 and outlet 32, which is downstream of the point within the shell 28 where the wet sand delivered through inlet 30 is substantially dry. This collar assembly is of the type illustrated in U.S. Pat. No. 5,664,882, which is incorporated by reference herein.

The assembly 40 includes a stationary housing 42 having an upper frac sand inlet 43 allowing wet sand to be gravitationally delivered into the housing 42. The adjacent portion of rotatable shell 28 has a series of circumferentially spaced wet sand inlet openings 44 in communication with housing 42; each opening 44 is equipped with an inwardly extending, tapered chute 46 for directing the wet frac sand into the shell 28. A series of spiral vanes or ribs 48 are secured to shell 28 downstream of the chutes 46 for advancing the wet frac sand towards shell outlet 32.

In practice, initial quantities of set fracturing sand introduced into inlet 30 pass through the shell 28 and are dried therein, owing to the induced draft of air afforded by the fan 26. This air is heated by means of burner/blower 34 to accomplish the drying function. As indicated, at some point along the length of the shell 28, the initially introduced quantities of wet sand are substantially dry (e.g., at least about 95% of the target final moisture level of the sand has been achieved), and downstream of this point, further additional quantities of wet sand are added through the collar 40; this wet sand is typically delivered to the collar 40 by a standard delivery belt arrangement, so that the wet sand falls by gravity into the collar 40. During the remainder of the travel of the initial and additional quantities of wet sand between collar 40 and outlet 32, the additional quantities of wet sand are evaporatively dried by the hot, substantially dry sand initially passing through the inlet 30, and all of the sand, both the initial and additional quantities, is cooled to an acceptable temperature. The exiting air currents, typically containing entrained particulates, are routed through duct 22 for treatment in knock-out box 16, and are further passed through duct 24 for final treatment in baghouse filter 18. Notably, neither ambient air nor cooling water is needed to cool the sand.

In order to accomplish these ends, the amount of sand initially fed into inlet 30 is substantially greater than that delivered via collar 40. In preferred forms, at least about 70-95 weight % (more preferably from about 80-85 weight %) of the total sand treated per unit time in dryer 12 is initially fed into inlet 30, and the remainder is introduced through the collar 40. The induced draft air currents typically are a −2 inches of water column across the dryer 12. The final product delivered to outlet 32 have a moisture content of from about ¼-1 weight %, and a temperature of from about 120-180° F. (more preferably from about 130-150° F.). The dryer fan motor can be substantially smaller than conventional wet sand multiple-pass rotary dryers, and a 40 HP motor has been found adequate in the illustrated embodiment. The conditioned sand from outlet 32 is in prime condition for downstream sizing, especially through the use of vibratory screens.

The invention thus provides both drying and cooling of wet fracturing sand within one co-current rotary vessel and without changing the flow path of the sand during treatment. In this way, equipment costs are significantly reduced as compared with rotary dryers equipped with multiple coaxial shells, and utility costs are greatly lessened.

The following comparative, computer-generated table sets forth the parameters of representative 150 ton/hour frac sand conditioning systems, namely a static fluid bed system, a vibratory fluid bed system, and four types of rotary systems, specifically counter-current and co-current systems, a rotary system with a cooling shell, and a system in accordance with the invention.

| | DRYER TYPE | | | | | |
|---|---|---|---|---|---|---|
| | STATIC | VIBRATORY | ROTARY DRYER | | | |
| Configuration | FLUID BED Dryer/Cooler | FLUID BED Dryer/Cooler | Counter-Current | Co-Current | Rotary w/ Cooling Shell | Invention |
| SYSTEM TYPE | | | | | | |
| Convective Heat Exchange Method | Static Fluid Bed | Vibratory Fluid Bed | Rotary Counter Flow | Rotary Co-Current Flow | Rotary Co-Current Flow | Rotary Co-Current Flow |
| System Configuration | Dryer/Cooler | Dryer/Evaporative Cooler | Dryer | Dryer | Dryer/Evaporative Cooler | Dryer/Evaporative Cooler |
| Product Output, TPH | 150 | 150 | 150 | 150 | 150 | 150 |
| DRYER DATA | | | | | | |
| Dimensions, ft | 11 × 36, oval bed | 6 × 26.58, rect bed | 7 dia × 30 Ig | 8 dia × 40 ft Ig | 11.5 dia × 42.6 Ig | 8 dia × 50 Ig |
| Critical Parameter | 322.5 sq ft bed (est) | 159.5 sq ft bed | 1185 fpm gas velocity | 496 fpm gas velocity | 389 fpm velocity at exit | 496 fpm gas velocity |
| Wet Feed Inlet Moisture, % | 6.0 | 6.0 | 6.0 | 6.0 | 6.0 | 6.0 |
| Wet Feed Inlet Temp, ° F. | 60 | 60 | 50 | 50 | 50 | 50 |
| Dryer Product Moisture, % | 1.00 | 1.00 | 0.50 | 0.50 | 1.00 | 1.00 |
| Dryer Product Temp, ° F. | 170 | 170 | 210-240 | 225 | 225 | 225 |
| BURNER DATA | | | | | | |
| Burner Configuration | Air heating furnace | Line mixing duct burner | Hauck Star-Jet 514360G | Hauck Eco-Star 50 | Hauck Beta BBGT-114 | Hauck Eco-Star 50 |
| Burner Max Output Capacity, MMBTU/HR | 20 | 36 | 75.6 | 63 | 32 | 63 |
| Burner Design Output, MMBTU/HR | 20 | 31 | 50 (est) | 41.5 | 27 | 27 |
| Heater Inlet Temp, ° F. | 70 | 125 | 70 | 70 | 70 | 70 |
| Heater Exit Temp, ° F. | 850 (est) | 850 | 2300 (est) | 2300 (est) | 1,472 | 1,475 |
| COOLER DATA | | | | | | |
| Dimensions, ft | 11 dia semi-circle | 6 × 4.4, cooler | None | None | 11.5 dia × 42.6 Ig | 8 dia × 10 Ig |
| Critical Parameter | 47.5 sq ft (est) | 74.4 sq ft bed | None | None | 15-20% wet feed to cooler | 15-20% wet feed to cooler |
| Cooler Feed Inlet Moisture, % | 1.0 | 1.0 | None | None | 1.0 | 1.0 |
| Cooler Feed Inlet Temp, ° F. | 170 | 170 | None | None | 225 | 225 |
| Cool Product Moisture, % | 0.5 | 0.5 | None | None | 0.5 | 0.5 |
| Cool Product Temp, ° F. | 140 | 110 | None | None | 140 | 140 |
| EXHAUST SYSTEM DATA | | | | | | |
| Exhaust Configuration | combined exhausting | separate exhausting | exhausting to K-D elbow | exhausting to Knock-out | combined exhausting | exhausting to Knock-out |
| Exhaust Cleanup | to Baghouse | to Baghouse | to Baghouse | Collector and Baghouse | to Baghouse | Collector and Baghouse |
| Dryer Exit Gas Volume, ACFM | 50,000 | 53,000 | 45,616 | 24,943 | 41,678 | 24,943 |
| Dryer Exit Gas Temp, ° F. | 150 | 148 | 325 | 255 | 255 | 255 |
| Cooler Exit Gas Volume, ACFM | 10,000 | 18,000 | N/A | N/A | 40,221 | 24,070 |
| Cooler Exit Gas Temp, ° F. | 140 | 125 | N/A | N/A | 230 | 230 |

-continued

| | DRYER TYPE | | | | | |
|---|---|---|---|---|---|---|
| | STATIC | VIBRATORY | ROTARY DRYER | | | |
| Configuration | FLUID BED Dryer/Cooler | FLUID BED Dryer/Cooler | Counter-Current | Co-Current | Rotary w/ Cooling Shell | Invention |
| Heat Recovery | None | Cooler exhaust recirc to Heater inlet plus Heater bypass ducts to Cooler fan and Baghouse inlets | None | none | "Evaporative cooling" via introduction 15-20% wet sand into outer Cooler shell of drum | "Evaporative cooling" via introduction 15-20% wet sand into collar into Cooler shell of drum |
| Primary Collector | 10 ft dia Cyclone collector | None | Knock-out Elbow | 8 ft × 8 ft Knock-out Box | Knock-out Elbow | 8 ft × 8 ft Knock-out Box |
| Primary Collector Discharge | Trickle valve | None | None | Double tipping valve | None | Double tipping valve |
| Primary Collector Dust Collected, lb/hr | 10500 | 0 | 0 | 13500 | 0 | 13500 |
| Baghouse Configuration | (765) ea 6" dia × 10 ft Ig | (714) ea 6" dia × 12 ft Ig | (528) ea 6" dia × 10 ft Ig dia | (320) ea 6" × 14 ft Ig | Unknown | (288) ea 6" dia × 12 ft Ig |
| Baghouse Hopper Discharge | Rotary airlock valve | Rotary airlock valve | Tipping valve | Rotary airlock valve | Rotary airlock valve | Rotary airlock valve |
| Baghouse Collector Dust Collected, lb/hr | | | | | | |
| Bags | 16 oz Polyester w/ PTFE | Unknown | 16 oz Nomex | 14 oz aramid | Polyester | 14 oz Aramid w/PTFE |
| Cloth Area, sq ft | 11,934 | 14,280 | 8,294 | 7,066 | 8,396 | 5.599 |
| Exhaust Exit Gas Volume, ACFM | 60,000 | 71,000 | 45,616 | 24,943 | 40,221 | 24,070 |
| Exhaust Exit Gas Temp, ° F. | 140 | 125-148 | 325 | 255 | 230 | 230 |
| Exh Dew Pt. Temp, ° F. | | | | | | |
| Air-to-Cloth Ratio | 5.0:1 | 5.0:1 | 5.5:1 | 3.53:1 | 4.79:1 | 4.30:1 |
| Cages | CS w/ Galvanized venturi | Unknown | Unknown | Galvanized | Unknown | Galvanized |
| Compressed Air Requirements, ACFM | Unknown | 96 | 56.1 | Unknown | Unknown | Unknown |
| CONNECTED HORSPOWER | | | | | | |
| Burner Blower HP | 50 | N/A | 75 | 30 | 50 | 30 |
| Sleeve Cooling Blower HP | N/A | 1.5 | N/A | N/A | N/A | N/A |
| Fluidizing Blower HP | 300 | N/A | N/A | N/A | N/A | N/A |
| Cooler Blower HP | 25 | 75 | N/A | N/A | N/A | N/A |
| Recirculation Blower HP | N/A | 200 | N/A | N/A | N/A | N/A |
| Exhaust Blower HP | 200 | 300 | 150 (est) | 125 | 125 | 125 |
| Drive(s) HP | N/A | 2 × 30 | 50 | 40 | 200 | 40 |
| Baghouse Screw Conveyor HP | 5 | 5 | 3 (est) | 3 (est) | 2 | 3 |
| Baghouse Airlock HP | 1 | 1 | N/A | 2 (est) | 1 | 2 |
| Total Connected HP | 581 | 643 | 278 | 200 | 378 | 200 |
| Total Connected KW | 433.4 | 479.7 | 207.4 | 149.2 | 282.0 | 149.2 |
| HOURLY ENERGY COSTS | | | | | | |
| Total Operating KW (70% fully loaded) | 303.4 | 335.8 | 145.2 | 104.4 | 197.4 | 104.4 |
| Hourly Electrical Cost @ $0.125/KW, $ | 37.92 | 41.97 | 18.15 | 13.06 | 24.67 | 13.06 |
| Hourly Burner Consumption, MMBTU/HR | 20 | 31 | 50 | 41.5 | 27 | 27 |
| Hourly Burner Cost @ $3.75/MMBTU, $ | 75.00 | 116.25 | 187.50 | 155.63 | 101.25 | 101.25 |
| Total Hourly Energy Costs, $ | 112.92 | 158.22 | 205.65 | 168.68 | 125.92 | 114.31 |
| Energy Efficiency, $/Ton | 0.75 | 1.05 | 1.37 | 1.12 | 0.84 | 0.76 |
| Evaporation Efficiency, BTU/LB evap | 1143 | 1771 | 2857 | 2371 | 1543 | 1543 |

Information pertaining to the Hauck burners may be found at the manufacturer's website, www.hauckburner.com.

"ACFM" is actual cubic feet per minute.

Attention is particularly directed to the energy costs of the comparative systems. The most significant parameter is the energy efficiency, in terms of dollars per ton. In the case of the system of the present invention, the efficiency is $0.76 per ton, which is significantly less than all other systems save for the static fluid bed system. However, this latter system has the deficiencies outlined above and has greater construction/commissioning expenses so that, all factors considered, the system of the invention is superior to all of the comparative systems.

FIGS. 4A-4H together set forth a computer-generated mass and energy balance for a 150 ton/hour drying/cooling system in accordance with the invention, where the directional arrows in FIGS. 4A-4G lead to the incoming arrows in the succeeding Figures. This demonstrates that commercial application of the invention can be readily accomplished using available technologies.

I claim:

1. A fracturing sand dryer assembly comprising:

an elongated, single-pass, axially rotatable shell presenting a wet sand inlet adjacent one end of said shell and sized to receive an initial quantity of wet sand, and a dry sand outlet adjacent the opposite end of the shell, said shell operable to move said sand from said inlet to said outlet;

apparatus operable to induce an air flow through and along the length of the shell, and to heat the air, in order to substantially dry said initial quantity of wet sand within the shell, said air flow being co-current with the movement of said sand through said shell; and structure operable to deliver an additional quantity of wet sand into said shell at an zone between said inlet and said outlet, and downstream of the point where said initial quantity of wet sand is substantially dry, such that said additional quantity of wet sand mixes with said initial quantity of substantially dry sand in order to evaporatively dry said additional quantity of wet sand, and to cool the initial and additional quantities of wet sand for delivery thereof to said outlet.

2. The dryer of claim 1, said apparatus comprising an induced draft fan assembly and a burner, said burner located adjacent said wet sand inlet.

3. The dryer of claim 1, said shell including a gas outlet, and apparatus downstream of said shell for removing particulates from the gas passing through the gas outlet, said particulate-removal structure comprising a knock-out box and a baghouse filter.

4. A method of drying fracturing sand, comprising the steps of:

passing an initial quantity of wet fracturing sand into the wet sand inlet of an elongated, single-pass, axially rotatable shell, and moving the sand along the length of the shell to an outlet;

inducing a flow of heated air through and along the length of said shell in order to dry said initial quantity of wet sand within the shell, said flow of heated air being co-current with the movement of said sand through said shell;

adding an additional quantity of wet sand into said shell at a zone downstream of the point where said initial quantity of wet sand is substantially dried; and causing said additional quantity of wet sand to be mixed with said substantially dried initial quantity of wet sand, in order to evaporatively dry the additional quantity of wet sand, and to cool the initial and additional quantities of wet sand.

5. The method of claim 4, including the step of removing particulates from said air passing through the shell.

6. The method of claim 4, said initial quantity of wet fracturing sand being from about 70-95% by weight of the total weight of the initial and additional quantities of wet sand.

* * * * *